US005405310A

United States Patent [19]

Yoo

[11] Patent Number: 5,405,310

[45] Date of Patent: Apr. 11, 1995

[54] ACUPRESSURE GLOVES ADHERED ACUPRESSURE DEVICES

[76] Inventor: Tae W. Yoo, 807, 1-Dong, Hanyang, Apt. 32-5, Banpo-dong, Seocho-ku, Seoul, Rep. of Korea

[21] Appl. No.: 166,574

[22] Filed: Dec. 13, 1993

[30] Foreign Application Priority Data

Sep. 3, 1993 [KR] Rep. of Korea ..... 1993-17457

[51] Int. Cl.[6] ..... A61H 39/00; A61H 7/00

[52] U.S. Cl. ..... 601/134; 606/204; 606/201

[58] Field of Search ..... 36/141; 2/159, 160, 2/161.7; 601/134, 135, 136, 138, 137; 606/201, 204, 204.15; 600/9, 15

[56] References Cited

U.S. PATENT DOCUMENTS

| | | | |
|---|---|---|---|
| 1,188,668 | 6/1916 | Madison | 128/62 R |
| 2,210,858 | 8/1940 | Loeber | 128/62 R |
| 4,244,057 | 1/1981 | Burnham | 2/160 |
| 4,320,760 | 3/1982 | Sun et al. | 606/204 |
| 4,598,484 | 7/1986 | Ma | 36/141 X |
| 4,694,831 | 9/1987 | Seltzer | 36/141 |
| 4,733,655 | 3/1988 | Smal | 601/135 X |
| 5,096,188 | 3/1992 | Shen | 601/134 X |
| 5,199,876 | 4/1993 | Waldman | 606/204 X |
| 5,213,007 | 5/1993 | Yoo | 74/558 |
| 5,224,397 | 7/1993 | Yoo | 74/558 |
| 5,251,387 | 10/1993 | Jürgens | 36/141 X |

FOREIGN PATENT DOCUMENTS

| | | | |
|---|---|---|---|
| 3819859 | 12/1989 | Germany | 606/204 |
| 1544428 | 2/1990 | U.S.S.R. | 601/134 |

*Primary Examiner*—Robert A. Hafer
*Assistant Examiner*—Brian E. Hanlon
*Attorney, Agent, or Firm*—Richard M. Goldberg

[57] ABSTRACT

An acupressure glove includes upper and lower skins which closely adhere to the back and palm of a hand, respectively, when worn by a user, the skins defining a cavity therebetween for receiving a hand; a plurality of receiving holes in the upper and lower skins; a plurality of hollow acupressure protuberances for applying acupressure to the hand, the protuberances being positioned within the cavity in association with selected receiving holes, each acupressure protuberance including a flat sheet portion which lies against the inner surface of one skin, a narrow neck portion extending toward the other skin from the flat sheet portion and a bulbous portion extending toward the other skin from the narrow neck portion, the narrow neck portion and the bulbous portion being hollow and the flat sheet portion having an opening which opens into the narrow neck portion; and a plurality of securing protuberances extending into the receiving holes and engaged within the plurality of hollow acupressure protuberances, respectively, for retaining the acupressure protuberances to the upper and lower skins, each securing protuberance including a second flat sheet portion which lies against an outer surface of one skin, a second narrow neck portion extending toward the other skin from the second flat sheet portion and a second bulbous portion extending toward the other skin from the second narrow neck portion, the bulbous portion having an outer dimension greater than the neck portion of the acupressure protuberances.

18 Claims, 4 Drawing Sheets

ACUPRESSURE GLOVES ADHERED ACUPRESSURE DEVICES

BACKGROUND OF THE INVENTION

This invention relates to acupressure gloves with adhered acupressure devices in the form of acupressure protuberances being made of non-ferrous metals for cooperation with blood vessels distributed on the palms, backs of hands or finger parts of the human body.

More specifically, it relates to an invention activating the living body activity by acupressure and ion treatment effect by means of the projected protuberances being made of non-ferrous materials.

In the interior of the human body there is a minute living electric current which operates or runs the living body. This current relates to electric physiological phenomena of muscle contractions, etc. If the balance of such minute living electric current is destroyed by an external influence of stress, etc., a magnetic change can occur, resulting in the living organization be inharmonious.

As a result of the above, in a part of the body in which there occurs a large disproportion, a disease or pain develops. Generally, as a means to settle this symptom, medicines such as painkillers have been prescribed. This therapy loses in some cases the effect of the medicine.

Accordingly, a magnetic physical means is needed to overcome this problem.

In the cuticle of the palms, the backs of the hands or finger parts, the pressure points corresponding to each part of the human body is distributed.

On the other hand, the cuticle of the skin has cations, and its endothelium has anions. Thus, when a force is applied to pressure points on the skin of the hands or fingers with a pressure device generating anions, the corresponding human body can be balanced.

As a pressuring device as described above, it is known to apply pressuring acupressure protuberance generating anions to the pressure points of the skin with adhesive tape. Also known is an acupressure device which provides a number of protuberances in a pattern, which applies a force upon being gripped by a hand.

Conventional pressuring devices as the above were, however, made to apply pressure to pressure points with adhesive materials. For this reason, the adhesive materials were easily separated from the skin because of the weakened adhesive power by sweat.

Furthermore, there was a roll-shaped acupressure device, which has acupressure protuberances, being gripped by a hand. In this case, the treatment effect was declined because the pressing positions of the acupressure protuberances were incorrect. It was inconvenient for a user to use because of the pressure applied with acupressure protuberances for a long time.

SUMMARY OF THE INVENTION

Thus, an object of this invention is to provide acupressure gloves with adhered acupressure devices which changeably apply pressure to pressure points according to the condition of a user, and acupressure devices with equipped acupressure protuberances being made of non-ferrous metal materials secured to the parts of the gloves corresponding to the backs and palms of the hands in receiving holes formed according to pressure points distributed on the skin.

Another object of this invention is to provide the acupressure gloves with adhered acupressure devices which are easily separatable and fixable as occasion demands, which form bonding devices to fixed pressuring devices, and which are fixed flexibly to the bonding protuberances of bonding devices to the inner side of acupressure protuberances.

BRIEF DESCRIPTION OF THE DRAWING

The features of the present invention will be hereafter explained in detail with reference to the accompanying drawings.

FIG. 4(*b*) is an arranged view of the receiving holes formed on the palm of a glove.

DESCRIPTION OF THE PREFERRED EMBODIMENT

Figure 1:
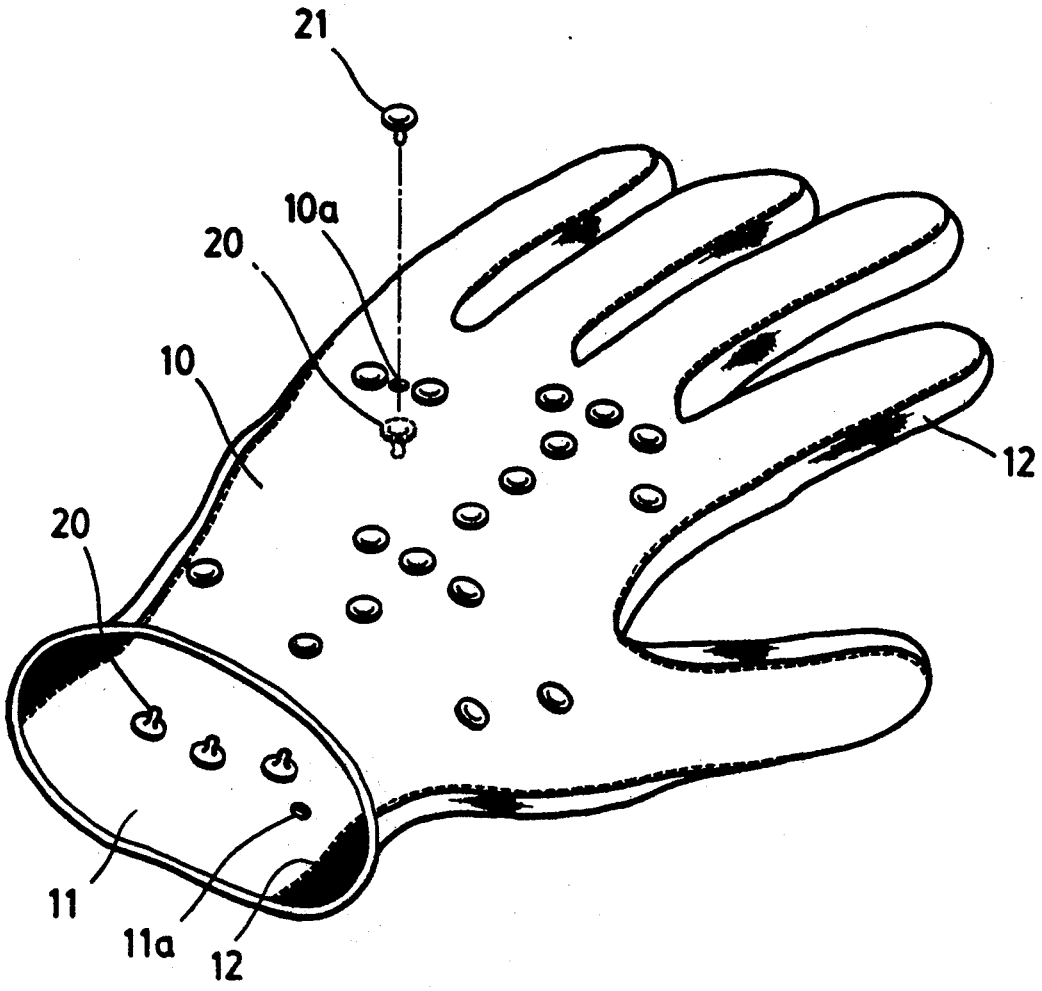
FIG. 1 is a perspective view showing the present invention.

The receiving holes 10*a* and 11*a* are formed at the upper skin 10 and the lower skin 11, and the bonding protuberance 21*a* of a bonding device 21 is fixed at the inner part of the acupressure protuberance of an acupressure device.

Referring to drawings, reference numeral 12 designates an elastic textile material.

A further description of the functions and effects of the present invention will be given as follows:

Because the upper skin 10 and the lower skin 11 are connected with elastic textile material 12, the elasticity is provided according to the hand action. In the upper skin 10 and the lower skin 11, the receiving holes 10*a*, 11*a* are formed. The receiving holes 10*a*, 11*a* are bored corresponding to pressure points which are distributed on the backs and palms of the hands.

Figure 4A:
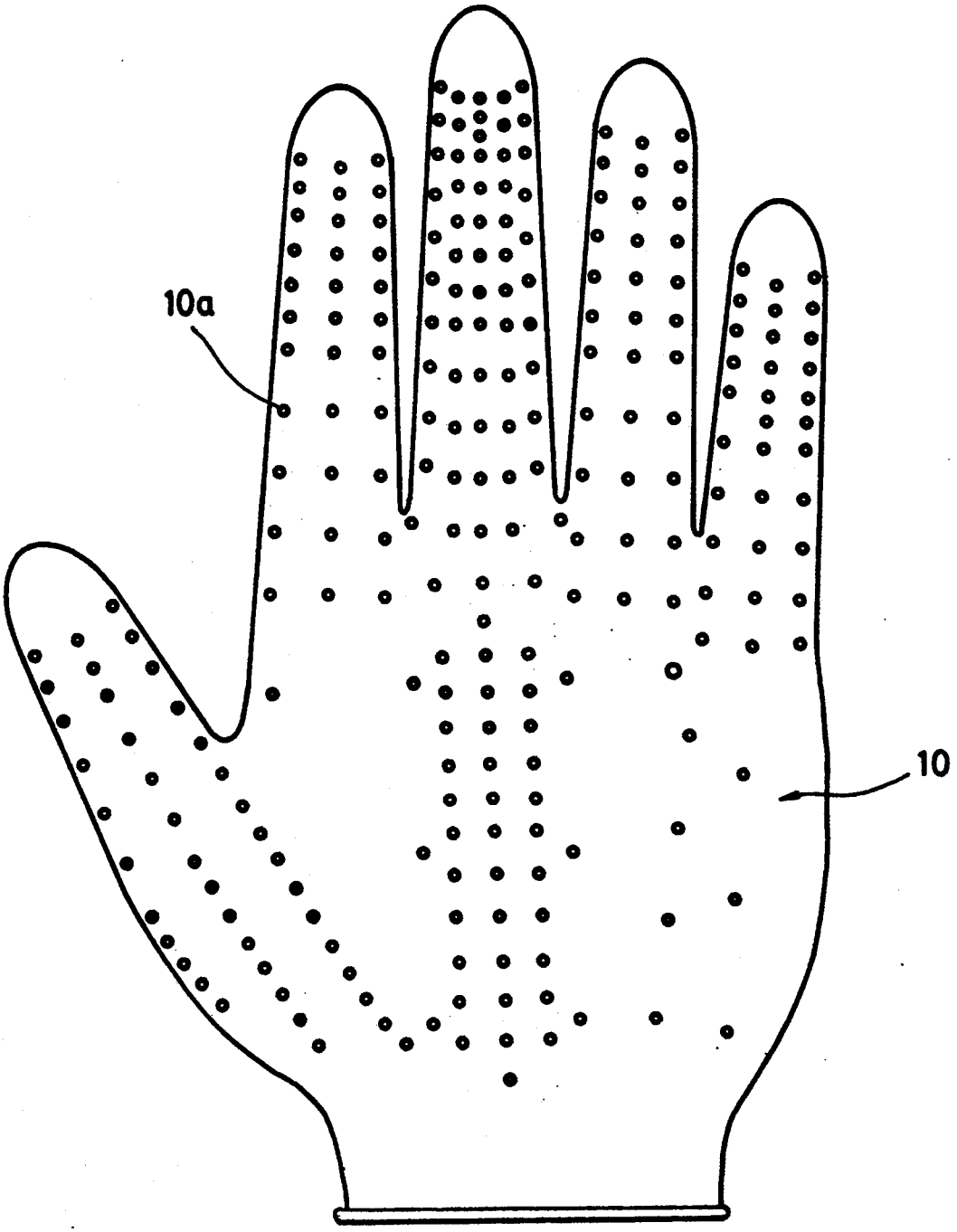
FIG. 4(*a*) is an arranged view of the receiving holes formed on the backs of a glove.
Figure 4B:
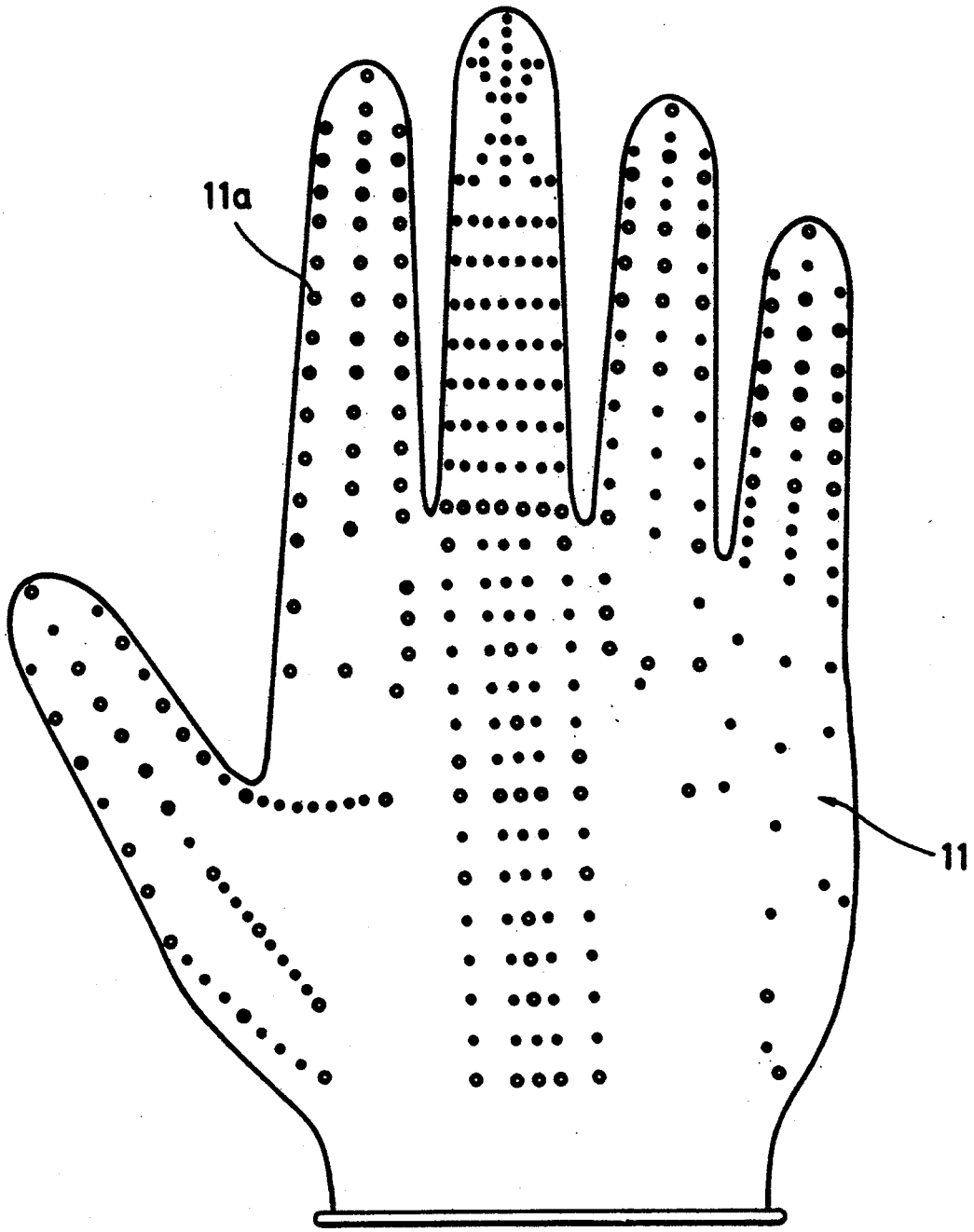

FIG. 4 is an arranged view showing the arranged embodiment of receiving holes.

On the backs and palms of the hands, the pressure points corresponding to each part of the human body are distributed. When force is applied at the pressure points, the living body activity of the corresponding parts of the human body is activated, thus providing a treatment effect.

Accordingly, when one puts on gloves, the receiving holes 10*a*, 11*a* must be located at the pressure points on the backs and palms of the hands.

Figure 2:
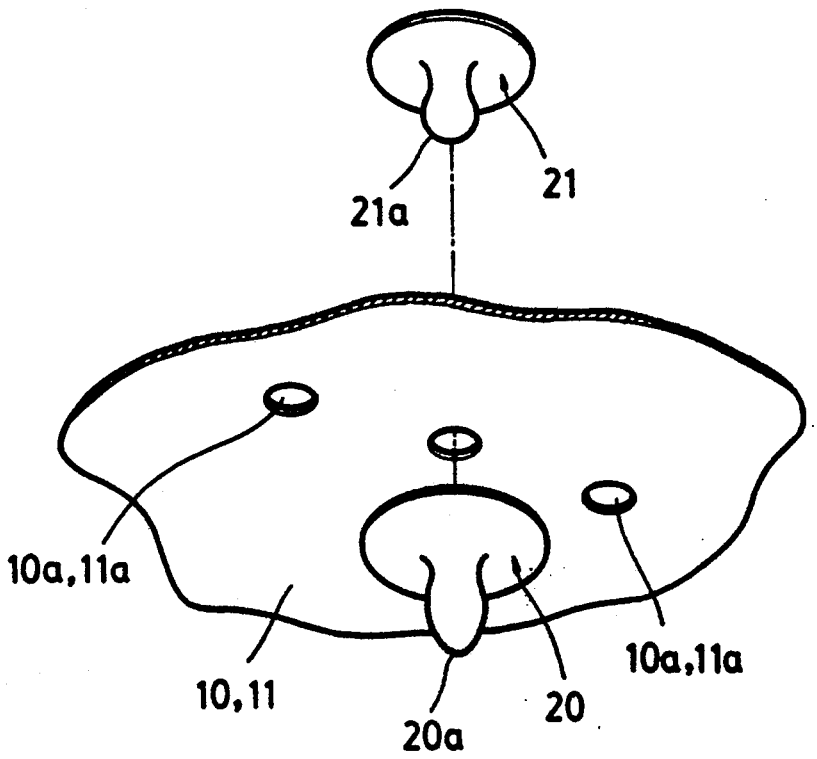
FIG. 2 is a partially enlarged separated perspective view showing the acupressure device and the bonding device.
Figure 3:
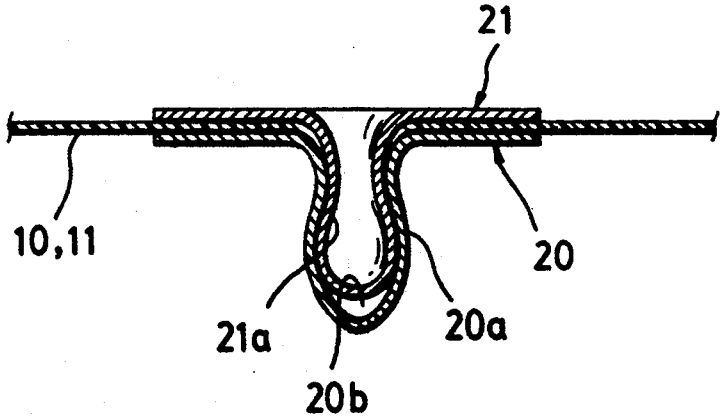
FIG. 3 is a cross-sectional view of FIG. 2.

FIGS. 2 and 3 are assembled views showing the acupressure device of the present invention.

An acupressure device 20 being made of non-ferrous metal or non-ferrous metal-plated materials, has an acupressure protuberance 20*a*, centrally of a circle-shaped flat sheet. In the interior of the acupressure protuberance 20*a*, a hollow is formed.

With non-ferrous metal materials being formed, the acupressure device 20 provides the ion effect by anions generating in themselves. The non-ferrous metal materials are Al, Au, Ag, Ni, etc.

The acupressure devices 20 are fixed at receiving holes 10*a*, 11*a* which are formed according to pressure points, thus giving pressure to pressure points on the skin.

A bonding device 21 is used to adhere an acupressure device 20 on the upper skin 10 and the lower skin 11 of the gloves. This bonding device 21 is in a shape having a bonding protuberance 21*a* extending from a circle-shaped sheet. Bonding protuberance 21*a* has a shape like the interior of a hollow of an acupressure protuberance 20*a*. This is to easily insert a bonding protuberance 21*a* into an acupressure protuberance 20*a* when a bonding device is fixed at an acupressure device.

Further, bonding device 21 is made from synthetic resin having ductility or materials having an equivalent characteristic.

Each of the acupressure protuberances 20*a* and bonding protuberances 21*a* have a tip with a conical shape. The neck part of each acupressure protuberance 20*a* extends to a circle-shaped sheet, and its diameter is less than the circle-shaped sheet of acupressure protuberance 20*a*.

Because of the shape of this neck part, a bonding protuberance 21*a* elastically inserts into an acupressure protuberance 20*a* providing the solid bonding force.

An acupressure device 20 is adhered to the base of a circle-shaped sheet toward the inside of the upper skin 10 and the lower skin 11 of gloves. The aperture which is formed in the hollow of an acupressure protuberance 20*a* is located at the receiving hole 10*a*, 11*a*, and the bonding protuberance 21*a* of a bonding device 21 is inserted into the hollow of an acupressure protuberance 20*a*. After being inserted, the neck part which is slightly expanded returns elastically in the original state to restrain a bonding protuberance 21*a* from separating therefrom.

Because each acupressure device 20 is fixed to the upper skin 10 and the lower skin 11 of gloves by the bonding protuberance 21*a* of a bonding device 21, it is easily separated. Thus, it provides the changeability by which a user can change a separated acupressure device 20 to the site of the receiving hole 10*a*, 11*a* corresponding to pressure points.

Further, even after it has been fixed to the upper skin 10 and the lower skin 11, each acupressure device 20 is inserted into a bonding protuberance 21*a* of a bonding device 21 to provide the solid bonding force. As the acupressure protuberance 20*a* of an acupressure device 20 fixed to the gloves stimulates the skin by the elasticity of the elastic textile material 12, the treatment effect is provided with the corresponding parts of the human body.

Further, because an acupressure device is made of non-ferrous metal materials, anions generated from the non-ferrous metal are transmitted to blood flowing in blood vessels, thereby distributing cations. Therefore, anions infiltrate in effete matter having cations in blood and distribute, resultingly promoting circulation of blood.

The gloves having the above acupressure devices 20 can be used for all sorts of sports, thus raising the effect of the sports together with providing acupressure treatment. When the grip of sporting apparatus, for example, in golf, badminton, tennis, etc., is gripped with the gloves on, there is pressure on the skin by acupressure devices 20.

As stated above, the receiving holes 10*a*, 11*a* are formed so as to adhere acupressure devices 20 to the upper and the lower skin of the gloves according to acupressure points. As an acupressure device 20 is fixed in the said receiving hole by a bonding protuberance 21, there is easy separation and while still providing a good bond. Accordingly, the present invention is a useful invention which not only provides changeability of adhering an acupressure device 20 but also provides a stable bonding force.

What is claimed is:

1. An acupressure glove comprising:

an upper skin which closely adheres to a back of a hand when worn by a user;

a lower skin which closely adheres to a palm of a hand when worn by a user;

said upper and lower skins defining a cavity therebetween for receiving the hand therein;

a plurality of receiving holes in said upper and lower skins;

a plurality of hollow acupressure protuberances for applying acupressure to said hand, said protuberances being positioned within said cavity defined by said upper and lower skins in association with selected ones of said receiving holes; and a plurality of securing protuberances extending into said receiving holes and engaged within said plurality of hollow acupressure protuberances, respectively, for retaining said acupressure protuberances to said upper and lower skins, said securing protuberances being hollow and having a shape similar to that of said acupressure protuberances.

2. An acupressure glove according to claim 1, wherein said acupressure protuberances are made from a non-ferrous metal material.

3. An acupressure glove according to claim 2, wherein said non-ferrous metal material is selected from the group consisting of aluminum, gold, silver and nickel.

4. An acupressure glove according to claim 2, wherein said securing protuberances are made from a synthetic resin material.

5. An acupressure glove according to claim 1, wherein said securing protuberances are made from a synthetic resin material.

6. An acupressure glove according to claim 1, wherein each said acupressure protuberance includes a flat sheet portion which lies against the inner surface of one of said skins, a narrow neck portion extending toward the other skin from said flat sheet portion and a bulbous portion extending toward the other skin from said narrow neck portion, said narrow neck portion and said bulbous portion being hollow and said flat sheet portion having an opening which opens into said narrow neck portion.

7. An acupressure glove according to claim 6, wherein said bulbous portion has a tip with a substantially conical shape.

8. An acupressure glove comprising:

an upper skin which closely adheres to a back of a hand when worn by a user;

a lower skin which closely adheres to a palm of a hand when worn by a user;

said upper and lower skins defining a cavity therebetween for receiving the hand therein;

a plurality of receiving holes in said upper and lower skins;

a plurality of hollow acupressure protuberances for applying acupressure to said hand, said protuberances being positioned within said cavity defined by said upper and lower skins in association with selected ones of said receiving holes, each said acupressure protuberance including a flat sheet portion which lies against the inner surface of one of said skins, a narrow neck portion extending toward the other skin from said flat sheet portion and a bulbous portion extending toward the other skin from said narrow neck portion, said narrow neck portion and said bulbous portion being hollow and said flat sheet portion having an opening which opens into said narrow neck portion; and a plurality of securing protuberances extending into said receiving holes and engaged within said plurality of hollow acupressure protuberances, respectively, for retaining said acupressure protuberances to said upper and lower skins, each said securing protuberance including a flat sheet portion which lies against an outer surface of one of said skins, a narrow neck portion extending toward the other skin from said securing protuberance flat sheet portion and a bulbous portion extending toward the other skin from said securing protuberance narrow neck portion, said securing protuberance bulbous portion having an outer dimension greater than said neck portion of said acupressure protuberances.

9. An acupressure glove according to claim 8, wherein said securing protuberance narrow neck portion and said securing protuberance bulbous portion are hollow and said securing protuberance flat sheet portion has an opening which opens into said securing protuberance narrow neck portion.

10. An acupressure glove comprising:

an upper skin which closely adheres to a back of a hand when worn by a user;

a lower skin which closely adheres to a palm of a hand when worn by a user;

said upper and lower skins defining a cavity therebetween for receiving the hand therein;

a plurality of receiving holes in said upper and lower skins;

a plurality of hollow acupressure protuberances for applying acupressure to said hand, said protuberances being removably positioned within said cavity defined by said upper and lower skins in association with selected ones of said receiving holes; and a plurality of securing protuberances, unsecured to said upper and lower skins, and removably extending into said receiving holes and removably engaged within said plurality of hollow acupressure protuberances, respectively, for retaining said acupressure protuberances to said upper and lower skins, said securing protuberances being hollow and having a shape similar to that of said acupressure protuberances.

11. An acupressure glove according to claim 10, wherein said acupressure protuberances are made from a non-ferrous metal material.

12. An acupressure glove according to claim 11, wherein said non-ferrous metal material is selected from the group consisting of aluminum, gold, silver and nickel.

13. An acupressure glove according to claim 11, wherein said securing protuberances are made from a synthetic resin material.

14. An acupressure glove according to claim 10, wherein said securing protuberances are made from a synthetic resin material.

15. An acupressure glove according to claim 10, wherein each said acupressure protuberance includes a flat sheet portion which lies against the inner surface of one of said skins, a narrow neck portion extending toward the other skin from said flat sheet portion and a bulbous portion extending toward the other skin from said narrow neck portion, said narrow neck portion and said bulbous portion being hollow and said flat sheet portion having an opening which opens into said narrow neck portion.

16. An acupressure glove according to claim 15, wherein each said securing protuberance includes a flat sheet portion which lies against an outer surface of one of said skins, a narrow neck portion extending toward the other skin from said securing protuberance flat sheet portion and a bulbous portion extending toward the other skin from said securing protuberance narrow neck portion, said securing protuberance bulbous portion having an outer dimension greater than said neck portion of said acupressure protuberances.

17. An acupressure glove according to claim 16, wherein said securing protuberance narrow neck portion and said securing protuberance bulbous portion are hollow and said securing protuberance flat sheet portion has an opening which opens into said securing protuberance narrow neck portion.

18. An acupressure glove according to claim 15, wherein said bulbous portion has a tip with a substantially conical shape.

* * * * *